United States Patent [19]

Gray

[11] 4,001,637

[45] Jan. 4, 1977

[54] LAMP BALLAST

[75] Inventor: George W. Gray, West Palm Beach, Fla.

[73] Assignee: Lutron Electronics Co., Inc., Coopersburg, Pa.

[22] Filed: June 12, 1975

[21] Appl. No.: 586,251

[52] U.S. Cl. ..... 315/205; 315/194; 315/200 R; 315/227 R; 315/247; 315/DIG. 7

[51] Int. Cl.[2] ..... H05B 41/16

[58] Field of Search ..... 315/171, 194, 199, 200 R, 315/205, DIG. 4, DIG. 7, 227 R, 247

[56] References Cited

UNITED STATES PATENTS

| | | | |
|---|---|---|---|
| 3,037,147 | 5/1962 | Genuit et al. | 315/205 |
| 3,780,342 | 12/1973 | Grimshaw et al. | 315/205 X |
| 3,819,982 | 6/1974 | Nelson | 315/DIG. 4 |

FOREIGN PATENTS OR APPLICATIONS

| | | | |
|---|---|---|---|
| 1,225,294 | 9/1966 | Germany | 315/DIG. 4 |

*Primary Examiner*—Eugene La Roche
*Attorney, Agent, or Firm*—Schiller & Pandiscio

[57] ABSTRACT

A ballast circuit for coupling a lamp to an AC power source and having in series between the source and lamp a non-dissipative current limiting capacitor feeding a rectifier, the output of the rectifier being connected to a smoothing filter. The ballast lends itself particularly to use in connection with a dimmer control, and permits the use of a secondary path or bypass around the dimmer control through another capacitor feeding a rectifier formed as a diode bridge, thereby providing a minimum current level path to the lamp.

14 Claims, 5 Drawing Figures

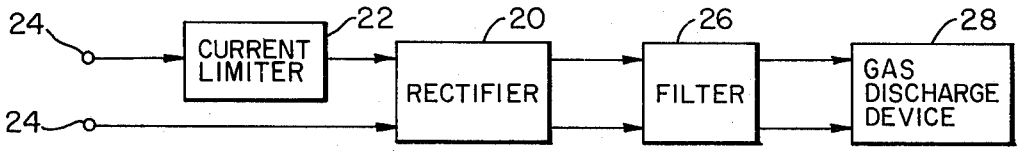
FIG. 1
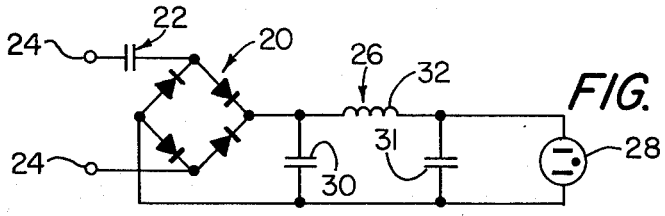
FIG. 2
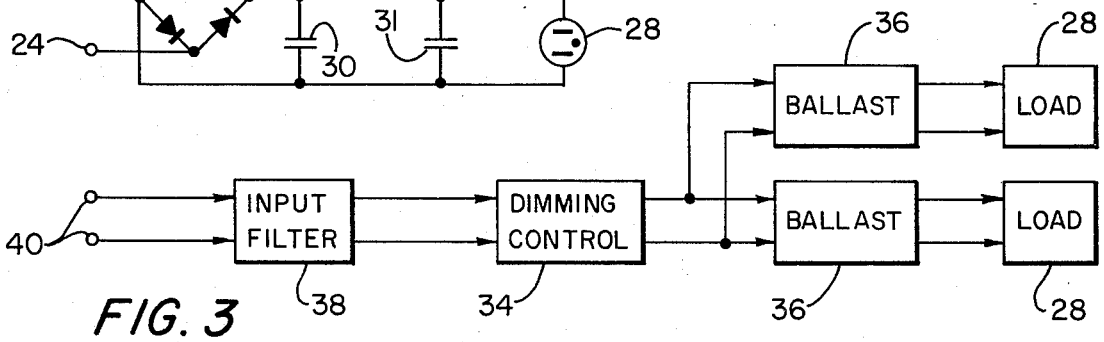
FIG. 3
FIG. 4
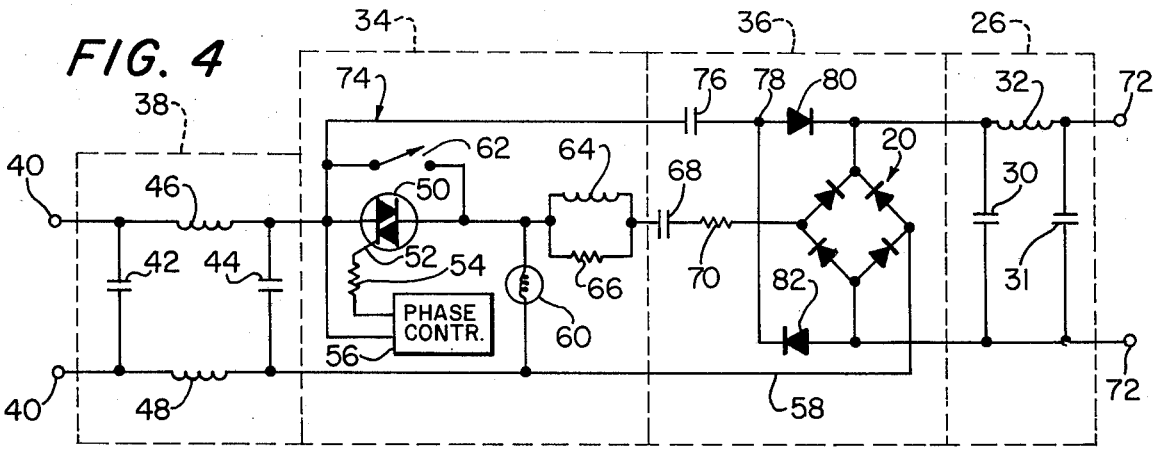
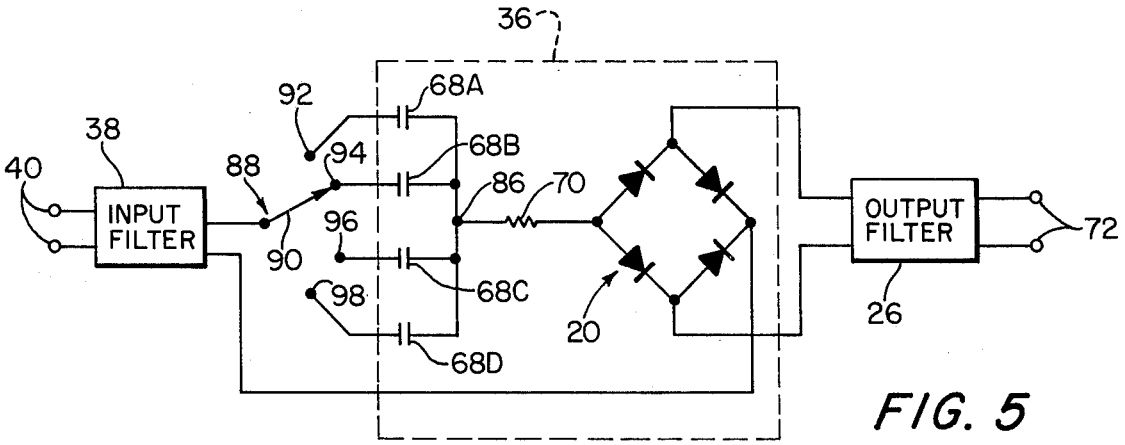
FIG. 5

LAMP BALLAST

This invention relates to lamp ballasts and more particularly to ballasts which are controllable for lamp dimming.

Vapor or gaseous-discharge lamps are sources of radiant energy emitted from ionized gas carrying a current between both electrodes. Characteristically, vapor lamps possess negative resistance characteristics, i.e. the resistance across the lamp decreases with an increase in current. When the lamp is started, the current will continue to increase until the lamp fails, unless some current limiting device is provided in the circuit to hold the lamp current below some maximum operating value.

Typically, a vapor lamp operated from a commercial 60 cycle source is provided with an inductive ballast connected in series with the lamp in order to provide current limiting. Another purpose of such ballast is to obtain lamp starting and voltage regulation. For example, a lamp may require a relatively high starting or striking voltage, but after vapor conduction is initiated, the operating voltage will be considerably lower. A series ballast serves to absorb the difference between the line voltage and the lamp operating voltage.

Ballasts which are series inductors or auto-transformers are commonly used, but control systems for dimming high intensity vapor lamps using such inductive ballasts have been only moderately successful. Solid state ballasts have been used for high intensity discharge lamps, and typically incorporate a high frequency switch regulator that provides all of the ballast functions. Dimming high intensity discharge lamps by regulating the current to such a high frequency switch regulator has been achieved. However, due to the limited ambient temperatures allowable with active solid state devices, (including for example, transistors, thyristors and the like) serious problems arise when these solid state ballasts are mounted in the luminaire. Consequently, such solid state ballasts are remotely located thereby increasing cost and complexity.

A principal object of the present invention is to provide a novel lamp ballast particularly adapted for dimming control. To this end, the basic ballast of the present invention for use in combination with a vapor lamp, comprises means for current-limiting power to the lamp, means for rectifying the power from the limiting means, and means for filtering the output of the rectifying means so as to apply filtered DC power to the lamp.

In a preferred embodiment of the invention, the current limiting means in non-dissipative in order to provide an economical and simple means for control of dimming.

Another object of the present invention is to provide a novel DC lamp-dimming ballast locatable in a luminaire for the lamp; to provide such a ballast with a leading power factor; and to provide a ballast capable of operating with many different lamp types interchangeably for any given wattage rating.

Yet another object of the invention is to provide a combination of the novel ballast with a dimming control comprising signal processing means for modifying AC power applied to the ballast so that the ballast and dimming control means constitute a variable current source to the lamp. In one embodiment the ballast provides a minimum current setting to prevent extinguishment of the lamp by the dimming control. In yet another embodiment, a minimum setting current input is provided to the ballast by a subsidiary path around the dimming control means.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in claims.

For a fuller understanding of the nature and objects of the present invention, reference should be had to the following detailed description taken in connection with the accompanying drawings wherein:

FIG. 1 is a block diagram of a ballast of the present invention;

FIG. 2 is an electrical schematic of the ballast of FIG. 1;

FIG. 3 is a block diagram of a number of exemplary ballasts of the present invention with dimming control coupled thereto;

FIG. 4 is an electrical schematic showing an alternative embodiment of a dimmer control-ballast combination incorporating the principles of the present invention; and FIG. 5 is a diagram partly in block and partly schematic illustrating another form of dimming control with the ballast of the present invention.

Generally, the ballast of the present invention simply comprises rectifier means, current limiting means (preferably non-dissipative) coupled to the rectifier input, and a low-pass filter coupled between the output of the rectifier and the input to the lamp. A dimming control, when provided, is preferably a bidirectional, phase-controlled switch coupled to the input of the current limiter of the ballast.

Referring now to the drawings wherein like numerals denote like parts, there will be seen in FIG. 1 a block diagram of a ballast of the present invention comprising rectifier 20, current limiting means 22 coupled between the input of the rectifier and at least one of power source terminals 24, and low-pass filter 26 connected between the output of the rectifier and a ballast load such as gas discharge device 28.

The ballast of FIG. 1 is shown schematically in FIG. 2 wherein rectifier 20 is embodied by a full wave diode bridge. As will be seen in FIG. 2, non-dissipative current limiting is achieved by providing current limiting means 22 in the form of a capacitor in series between power source terminal 24 and bridge 20. The filter 26 in FIG. 2 is shown as an exemplary network formed of series inductance 32 which serves as a choke, and a pair of parallel capacitors 30 and 31 which are primarily useful to remove transient spikes and provide high voltage for starting. It will be appreciated that because the ballast unit shown in FIG. 2 contains only passive elements it is much less sensitive to ambient thermal variations than a ballast formed of active elements, and can therefore be mounted directly in a lamp fixture or luminaire for gas discharge device 28.

FIG. 3 is a block diagram showing dimming control means 34 used in connection with a number of ballasts 36 (only two being shown) of the type described in connection with FIGS. 1 and 2. Ballasts 36 in turn are each connected at the input of a respective gas discharge device indicated as loads 28 in FIG. 3. Of course, a larger or lesser number of ballasts can be wired in parallel to one another and connected in common to the output of dimming control means 34, and the ballasts do not need to be of the same wattage. At the input of dimming control means 34 there is preferably an input filter 38. The input of the latter is connectable through terminals 40 to a power source which can either be an AC or a commutated DC source.

Elements of FIG. 3 are shown in circuit schematic form in FIG. 4 wherein it will be seen that input filter 38 comprises a pair of parallel condensers 42 and 44 connected across input terminals 40. Similarly, a pair of series inductances 46 and 48 are provided, each one connected to a respective terminal 40 and between like plates of capacitors 42 and 44. Dimming control means 34 comprises a bidirectional controllable electrically conductive element such as triac 50 for regulating current flow into the rectifier. Gate 52 of triac 50 is connected through resistor 54 to one input terminal of phase control unit 56 for controlling conduction through the triac. The input terminal of triac 50 is connected to an output terminal of filter 38 and to another input terminal of phase control 56. Phase control unit 56 typically can be a thyristor phase control unit such as is described in *G.E. Silicon Controlled Rectifier Manual*, 5th ed., on page 252, although it will be obvious to those skilled in the art that other known systems for controlling conduction through triac 50 can also be used. One output side of filter 38 is connected to common line 58. A small load 60, typically in the form of an incandescent bulb, is connected between the output of triac 50 and common line 58 in order to provide appropriate starting conditions. Mechanical switch 62 is connected across triac 50. The output terminal of triac 50 is also connected to an output filter formed of choke coil 64 and resistor 66 in parallel with one another. Choke coil 64 serves to eliminate spikes associated with the turning on of triac 50 and resistor 66 is intended to suppress or eliminate ringing from coil 64.

The output from the dimming control filter of FIG. 4 (formed of choke coil 64 and resistor 66) is connected to the input of ballast 36 by being applied directly to input current limiting capacitor 68. The output of capacitor 68 is connected through a small series resistor 70 to one input terminal of rectifier bridge 20. Another input terminal of bridge 20 is connected to common line 58. The output of rectifier 20 is connected (as in FIG. 2) to filter 26 formed of parallel capacitors 30 and 31 and series inductance 32. The output of filter 26 is connected to a pair of output terminals 72 across which there is to be connected a load (typically transiently exhibiting a negative resistance) such as a vapor or gas discharge lamp.

In the form shown in FIG. 4, the system also includes a minimum dimming level path 74 which is connected between input terminal of triac 50 and rectifier bridge 20. Path 74 comprises the necessary conductive leads together with series capacitor 76, one plate of which is connected to the input terminal of triac 50 and the other plate of which is connected to junction 78. A pair of diodes 80 and 82 are respectively connected between junction 78 and respective output terminals of full-wave diode bridge 20.

In describing the operation of the embodiment of FIG. 4 some exemplary circuit values may be helpful. Thus, one can assume that the power source at which input terminals 40 are to be connected is a 230 volt 60 cycle source, and that the lamp to be connected across output terminals 72 is a 400 watt mercury vapor lamp. Then typically, triac 50 = 2N5443;
lamp 60 = 25W 240 V incandescent lamp;
choke coil 64 = 1 mH;
capacitor 68 = 20$\mu$F;
resistor 70 = 5 ohms;
coil 32 = 300 mH;
capacitors 30, 31 = 0.068 $\mu$F;

It will be apparent that noise from the source connected across terminals 40 will be eliminated by filter 38. For starting; switch 62 is closed, bypassing triac 50, and the signal from filter 38 is then applied to rectifier bridge 20 through capacitor 76 and capacitor 68 and resistance 70. The rectified output of bridge 20 is applied through filter 26 to a lamp connected across terminals 72. For protection against having switch 62 open at starting, resistor 70 is provided in series with current limiting capacitor 68 so that the current is limited to approximately 9 or 10 amperes.

As soon as the lamp across terminals 72 is sufficiently warmed up, switch 62 is opened so that current from input filter 38 must then be applied to triac 50. While switch 62 is herein described as mechanical, it is apparent that it can be replaced with a known type of electronic switch which, for example, would be operated automatically in response to known detection circuits which monitor lamp current or lamp temperature to determine that the lamp was sufficiently warmed up for the switch to open. Similarly, current limiting resistor 70 could be placed elsewhere in the ballast circuit, and indeed might even be included in the resistance of coil 32 in output filter 26.

The current flowing through triac 50 to bridge 20 can be controlled within maximum and minimum limits by phase control unit 56 as is well known to those skilled in the art. Phase control unit 56 thus constitutes a manually operable dimmer for a lamp connected across terminals 72. It should be noted that the output of filter 38 is also applied directly to capacitor 76, and a current limited by the value of capacitor 76 is thus added by diodes 80 and 82 to whatever current is provided to bridge 20 through capacitor 68. The value of capacitor 76 is selected to provided in conjunction with the current established by capacitor 68, the rated current to a lamp across terminals 72 at maximum or full intensity conduction of triac 50. The diode bridge circuit formed of rectifier bridge 20 and diodes 80 and 82 has the effect of rectifying and adding the currents arriving along the two separate input paths.

When one dims the lamp by reducing current, because of the negative resistance of the lamp the voltage tends to rise. For a typical mercury lamp however, the 220 volt source does not constitute a good current source so the rise in voltage tends to reduce the current even more, ultimately even extinguishing the lamp. Thus, capacitor 76, operating in conjunction with diodes 80 and 82, establishes a minimum dimming level to prevent lamp extinguishment notwithstanding insufficient current conduction through triac 50 to keep the lamp operating. For the same typical mercury lamp however, at higher supply voltages (e.g. 440 v), capacitor 76 and its bypass path may not be required at all.

Clearly, the present invention is not limited to the use of a triac and phase control for the dimming unit, but instead any controllable bidirectional current carrying device can be used, and the control of the current in such device can be achieved through either known analog or digital circuitry. For example, as shown in FIG. 5, a particularly simple form of dimmer control can be used to provide dimming in a number of discrete steps of stages. As shown, the current limiter of ballast 36 includes a plurality of non-dissipative current limiting means in the form of capacitors 68*a*, 68*b*, 68*c*, and 68*c*, all having one terminal thereof connected in common to junction 86 at one end of resistor 70. The other end of resistor 70 is connected, as in the embodiment of FIG. 4, to an input terminal of rectifier bridge 20. Resistor 70 is not needed in some embodiments because of the presence of other resistive impedance in the input to bridge 20, and in yet other embodiments resistor 70 is advantageously non-linear.

The dimming control of FIG. 5 comprises means for connecting various of the current limiting capacitors to the power source and thus a multiposition switch 88 having a movable (e.g. manually or automatically) armature of switch blade 90, the input of which is connected to an output from filter 38. Blade 90 is connectable alternatively to any one of terminals 92, 94, 96 and 98. The latter terminals are respectively connected as inputs to capacitors 68*a*, 68*b*, 68*c* and 68*d*. Each of the latter capacitors has a capacitance which differs from that of any of the other capacitors. Hence, the current flowing into rectifier bridge 20 will be different for each position of switch 88. Of course, while the embodiment of FIG. 5 shows only four current limiting capacitors, each of which can be selectively and exclusively connected in series to the input to rectifier bridge 20, it will be recognized that the number of capacitors employed is largely a matter of choice, and indeed the capacitors and switching arrangement thereof can be provided in a variety of networks employing combinations of series and parallel capacitors without departing from the spirit of the invention.

Since certain changes may be made in the above apparatus without departing from the scope of the invention herein involved, it is intended that all matter contained in the above description or shown in the accompanying drawing shall be interpreted in an illustrative and not in a limiting sense. For example, it is apparent that a very large variety of filter networks can be employed in place of the simple filters described in connection with the invention. Similarly, the invention broadly should not be considered limited to a diode bridge but other rectifying devices and circuits are equally useful in most instances.

What is claimed is:

1. For use in a circuit for coupling an electrical vapor lamp to a cyclic electrical power source, a ballast comprising in series:

first substantially non-inductive, non-dissipative, capacitive, current limiting means having an input couplable to said source;

rectifying means connected to the output of said current limiting means; and filter means having an input connected to the output of said rectifying means, and an output connectable to said lamp.

2. A circuit as defined in claim 1 wherein said rectifying means is a full-wave diode bridge.

3. A circuit as defined in claim 1 wherein said filter means is a low-pass filter.

4. A circuit as defined in claim 1 including an input low-pass filter for coupling said first current limiting means to said source.

5. A circuit as defined in claim 1 including dimming control means for controlling input current to said ballast.

6. A circuit as defined in claim 5 wherein said dimming control means is connected to the input of said first current limiting means.

7. A circuit as defined in claim 6 wherein said first current limiting means comprises a plurality of non-dissipative elements, and said dimming control means comprises means for selectively coupling various of said elements to said power source.

8. A circuit as defined in claim 6 wherein said dimming control means comprises bidirectional controllable current conductive means for regulating current flow between said power source and said ballast in a first path, and means for controlling conduction through said current conductive device.

9. A circuit as defined in claim 8 wherein said controllable current conductive means comprises a semiconductor device and said means for controlling comprises phase control means.

10. A circuit as defined in claim 9 wherein said semiconductor device is a triac.

11. A circuit as defined in claim 8 including a second current conductive path between said power source and said ballast and second current limiting means for limiting current flow in said second path.

12. A circuit as defined in claim 11 wherein said second current limiting means is non-dissipative.

13. A circuit as defined in claim 11 wherein said second current limiting means is a capacitor.

14. A circuit as defined in claim 11 wherein said rectifying means comprises a full-wave flow diode bridge, said first path being connected to said bridge through said first current limiting means, said second path being connected to said bridge through a pair of unidirectional current conductive elements connected across said bridge.

* * * * *